US008955171B1

(12) United States Patent
Ariche

(10) Patent No.: US 8,955,171 B1
(45) Date of Patent: Feb. 17, 2015

(54) FLUSHABLE AND FOLDABLE TOILET SEAT COVER

(71) Applicant: Bravion Ariche, Dallas, TX (US)

(72) Inventor: Bravion Ariche, Dallas, TX (US)

( * ) Notice: Subject to any disclaimer, the term of this patent is extended or adjusted under 35 U.S.C. 154(b) by 0 days.

(21) Appl. No.: 14/150,992

(22) Filed: Jan. 9, 2014

(51) Int. Cl.
*A47K 13/14* (2006.01)
*A47K 13/24* (2006.01)
*A47K 13/16* (2006.01)

(52) U.S. Cl.
CPC ..... *A47K 13/16* (2013.01)
USPC ..... 4/245.5

(58) Field of Classification Search
USPC ..... 4/245.1–245.8
See application file for complete search history.

(56) References Cited

U.S. PATENT DOCUMENTS 3,579,669 A 5/1971 Loewenstein
4,586,202 A * 5/1986 Uchida ..... 4/245.5
4,589,149 A 5/1986 Bassi
6,813,784 B1 11/2004 Thompson

* cited by examiner

*Primary Examiner* — Tuan N Nguyen
(74) *Attorney, Agent, or Firm* — Crossley Patent Law

(57) ABSTRACT

A toilet seat cover providing a flushable, foldable covering having a top side and an outer edge that cover an entire top surface and outer side, respectively, of a toilet seat having a forward open mouth. A channel centrally disposed in a bottom side of the covering has a continuous outer periphery with an elastomeric edge to accommodate insertion of the toilet seat therethrough to permit the covering to be placed onto the toilet seat. Straight foldable score lines disposed horizontally and vertically on the top side and the outer edge are arranged perpendicular to each other in a crisscross pattern of sections. The score lines permit transformation from a fully folded position with the sections arranged in a compressed, stacked configuration for packaging and transport to a fully unfolded position to cover a toilet seat.

9 Claims, 4 Drawing Sheets

FLUSHABLE AND FOLDABLE TOILET SEAT COVER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of hygienic coverings for toilet seats are known in the prior art. However, what is needed is a hygienic toilet seat cover that is flushable, and further, is foldable along score lines for ready availability, packaging, and transport.

FIELD OF THE INVENTION

The present invention relates to toilet seat covers, and more particularly, to a flushable, foldable toilet seat cover.

SUMMARY OF THE INVENTION

The general purpose of the present flushable, foldable toilet seat cover, described subsequently in greater detail, is to provide a flushable, foldable toilet seat cover which has many novel features that result in a flushable, foldable toilet seat cover which is not anticipated, rendered obvious, suggested, or even implied by prior art, either alone or in combination thereof.

To accomplish this, the present toilet seat cover is devised to provide a single use disposable hygenic toilet seat cover to protect an individual against germs and infections. The device includes a flushable, foldable covering configured to fit onto, conform to, and cover a toilet seat having a forward open mouth. A top side and an outer edge of the covering are configured to cover an entire top surface and outer side, respectively, of the toilet seat. A channel disposed in a bottom side of the covering has a continuous outer periphery with an elastomeric edge. The channel is configured to accommodate insertion of the toilet seat therethrough to permit the covering to be placed onto the toilet seat.

A plurality of straight foldable score lines, which is disposed on the top side and the outer edge, include a plurality of vertical and horizontal fold lines arranged in a crisscross pattern of sections with the vertical and horizontal fold lines being perpendicular to each other. The score lines permit the covering to be transformable from a fully folded position for packaging and also for transport to a fully unfolded position to cover a toilet seat. The sections are arranged in a compressed, stacked configuration when the covering is disposed in the fully folded position.

The covering is biodegradable and is formed of a fibrous material. The fibrous material is formed of a soft cushion constructed of at least one ply paper. The fibrous material has thickness in a range of 0.10 millimeter to 25.4 millimeters.

Thus has been broadly outlined the more important features of the present flushable, foldable toilet seat cover so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
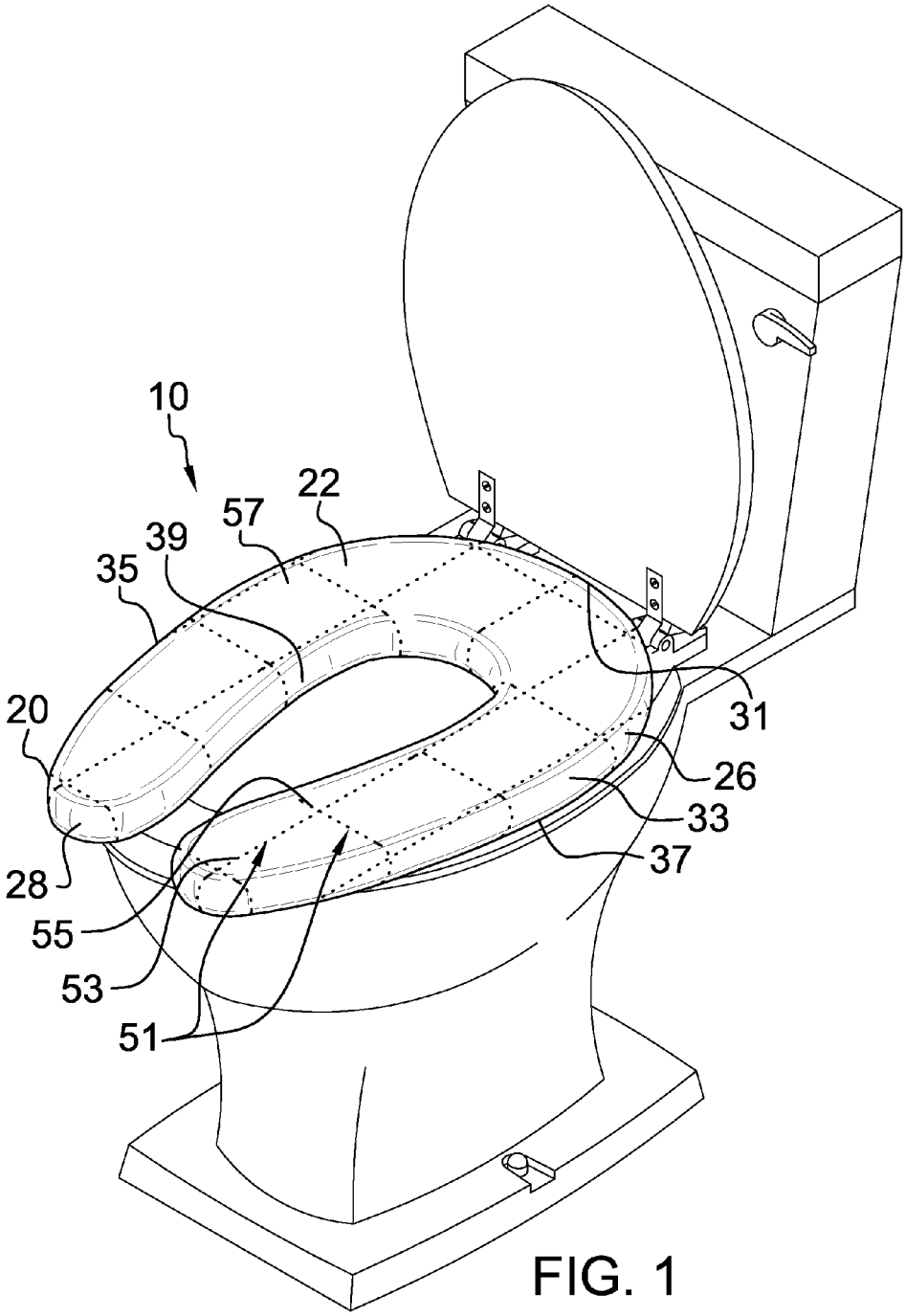
FIG. 1 is an in-use perspective view shown installed on a toilet seat.
Figure 2:
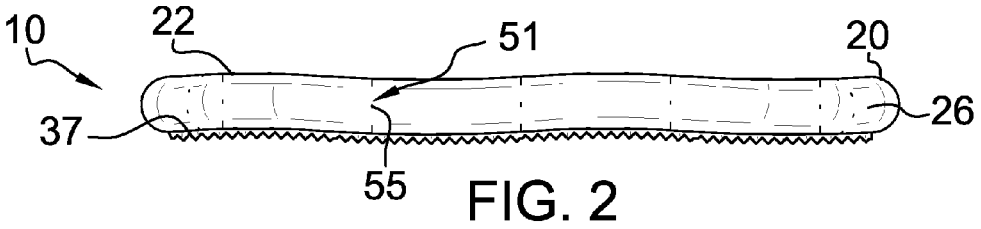
FIG. 2 is a side elevation view.
Figure 3:
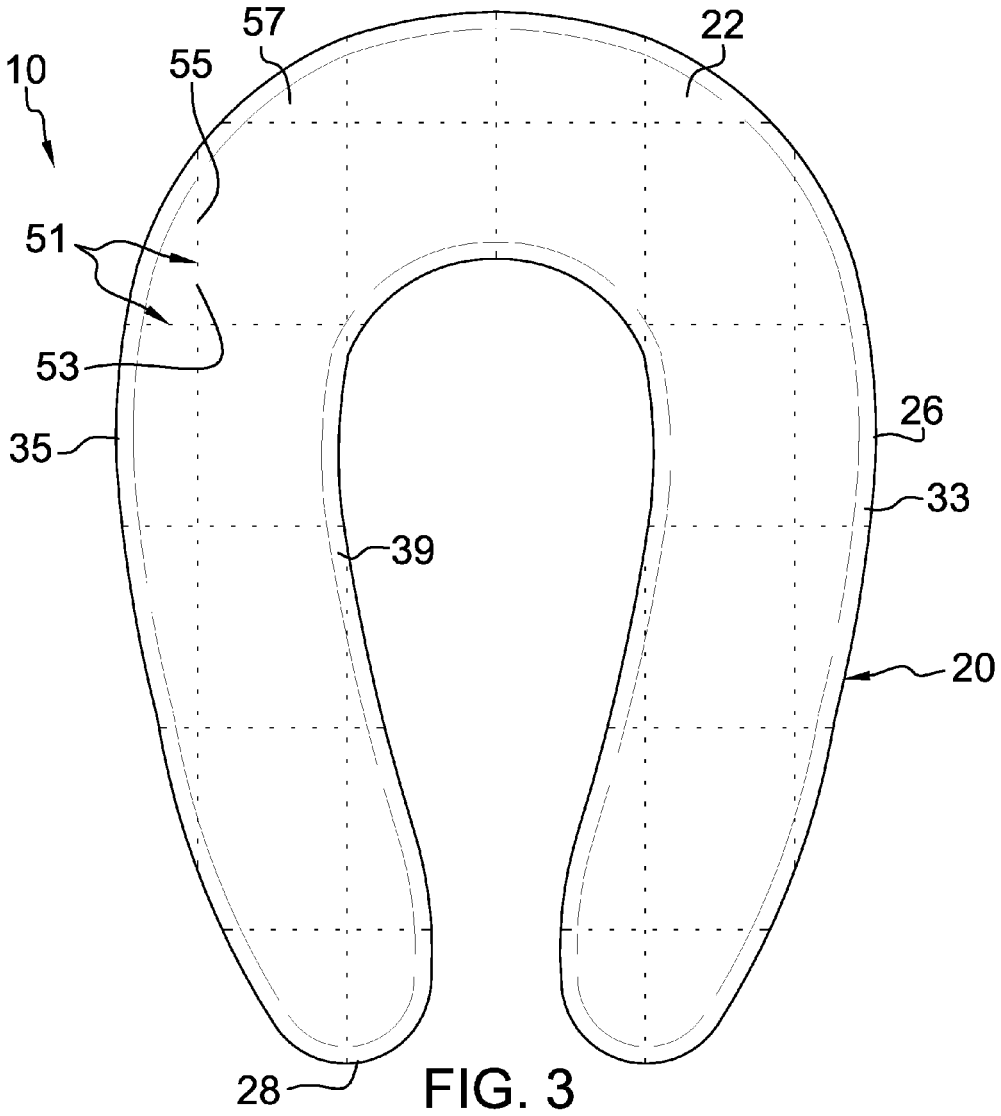
FIG. 3 is a top plan view.
Figure 4:
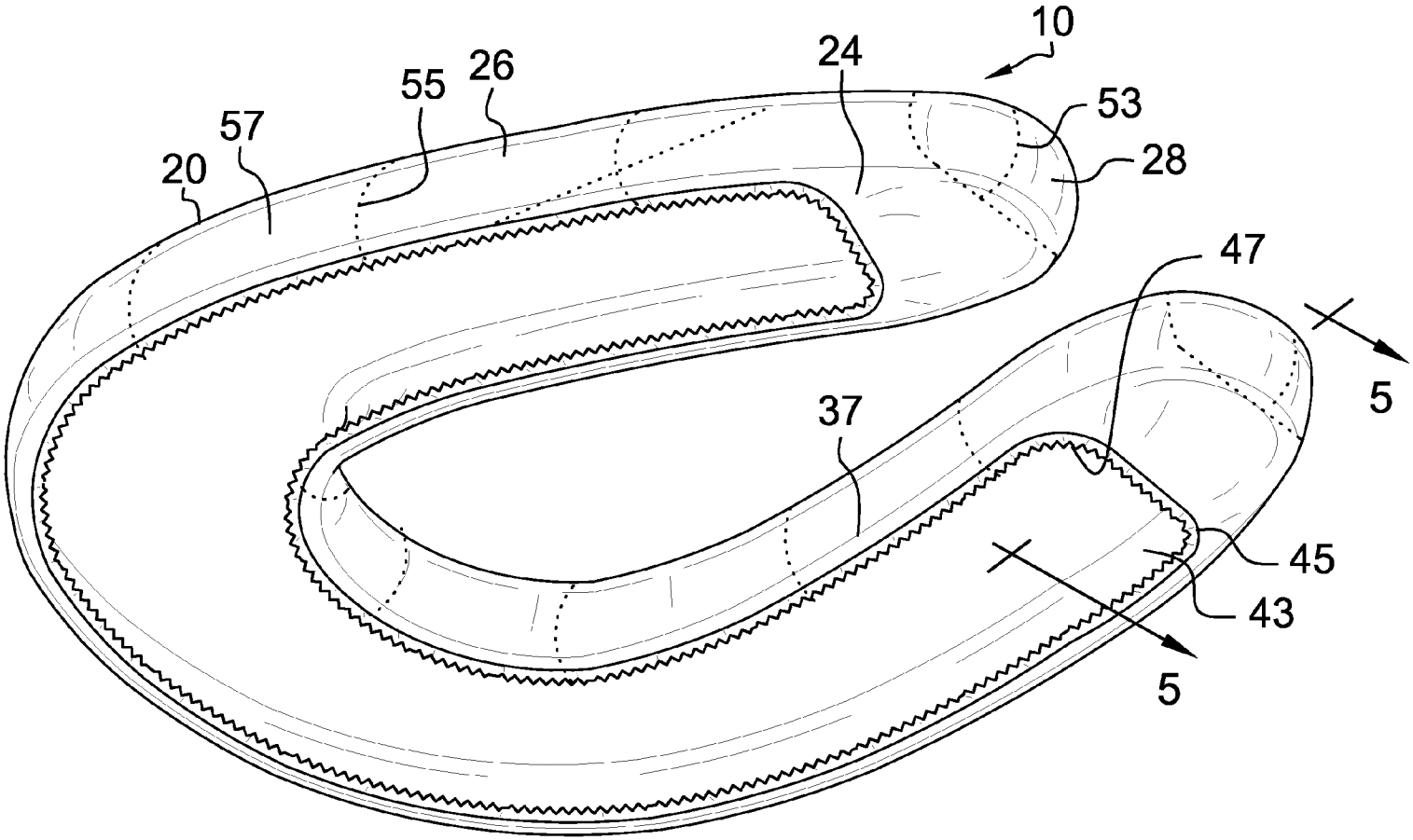
FIG. 4 is an in-use bottom perspective view.
Figure 5:
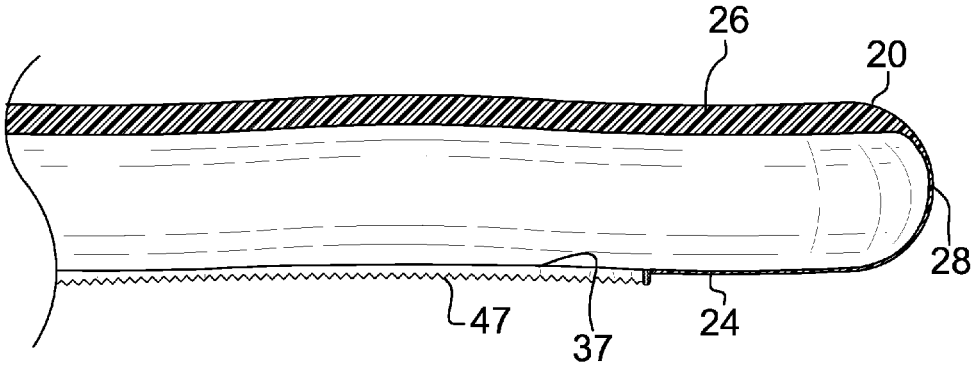
FIG. 5 is a cross-sectional view taken along line 5-5 of FIG. 4.

With reference now to the drawings, and in particular FIGS. 1 through 6 thereof, an example of the instant flushable, foldable toilet seat cover employing the principles and concepts of the present flushable, foldable toilet seat cover and generally designated by the reference number 10 will be described.

Referring to FIGS. 1 through 6, the present flushable, foldable toilet seat cover 10 is illustrated. The present toilet seat cover 10 includes a flushable, foldable covering 20 configured to fit onto, conform to, and cover a toilet seat having a forward open mouth. The covering 20 includes a top side 22, a bottom side 24 opposite the top side 22, and an outer edge 26 continuously disposed between the top side 22 and the bottom side 24. The top side 22 is configured to cover an entire top surface of the toilet seat. The outer edge 26 has a pair of opposing front ends 28, a back end 31, a right side 33, a left side 35, a bottom end 37, and an inner side 39 disposed between the pair of front ends 28. The outer edge 26 is configured to cover an entire outer side of the toilet seat.

A channel 43 is centrally disposed in the bottom side 24. An outer periphery 45 is continuously disposed along the channel 43. The outer periphery 45 is disposed adjacent the bottom end 37 of the outer edge 26 except for a portion proximal each of the front ends 28. The portion of outer periphery 45 proximal each of the front ends 28 is disposed a distance away form each of the front ends 28 in a range of approximately one-eighth to one-quarter of a length from the front end 28 to the back end 31. An elastomeric edge 47 is continuously disposed along the outer periphery 45. The channel 43 is configured to accommodate insertion of the toilet seat therethrough to permit the covering 20 to be placed onto the toilet seat.

Figure 6:
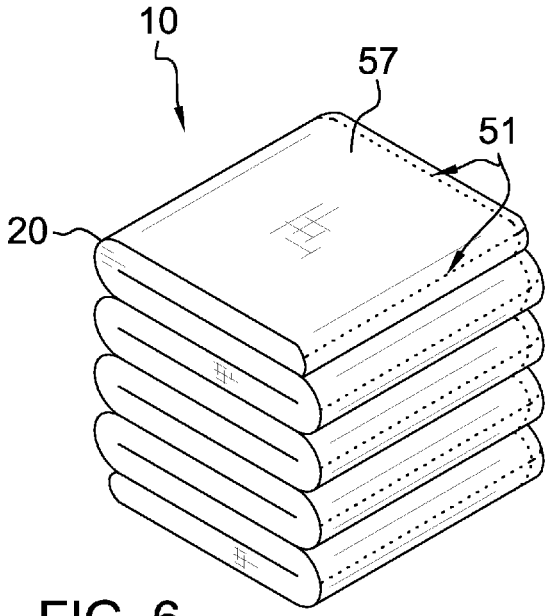
FIG. 6 is a perspective view shown in a folded position.

A plurality of straight foldable score lines 51 disposed on the top side 22 and the outer edge 26. The score lines 51 include a plurality of vertical fold lines 53 continuously disposed from each of the front ends 28 to the back end 31 and a plurality of horizontal fold lines 55 continuously disposed from the right side 33 to the inner side 39 and from the left side 35 to the inner side 39. The vertical fold lines 53 and the horizontal fold lines 55 are arranged in a crisscross pattern of sections 57 with the vertical and horizontal fold lines 53, 55 being perpendicular to each other. The score lines 51 permit the covering 20 to be transformable from a fully folded position, as illustrated in FIG. 6, for packaging and also for transport to a fully unfolded position to cover a toilet seat, as illustrated in FIG. 1. The sections 57 are arranged in a compressed, stacked configuration when the covering 20 is disposed in the fully folded position. The covering 20 has a toilet-seat shape in the fully unfolded position.

The covering 20 is biodegradable and is formed of a fibrous material. The fibrous material is formed of a soft cushion constructed of at least one ply paper. The fibrous material has thickness in a range of 0.10 millimeter to 25.4 millimeters.

What is claimed is:

1. A toilet seat cover comprising:

a flushable, foldable covering configured to fit onto, conform to, and cover a toilet seat having a forward open mouth, the covering comprising:

a top side configured to cover an entire top surface of the toilet seat;

a bottom side opposite the top side;

an outer edge continuously disposed between the top side and the bottom side, the outer edge having a pair of opposing front ends, a back end, a right side, a left side, and an inner side disposed between the front ends, the outer edge configured to cover an entire outer side of the toilet seat;

a channel centrally disposed in the bottom side;

an outer periphery continuously disposed along the channel; and an elastomeric edge continuously disposed along the outer periphery;

wherein the channel is configured to accommodate insertion of the toilet seat therethrough.

2. The toilet seat cover of claim 1 further comprising:

a plurality of straight foldable score lines disposed on the top side and the outer edge, the score lines comprising:

a plurality of vertical fold lines continuously disposed from each of the front ends to the back end; and a plurality of horizontal fold lines continuously disposed from the right side to the inner side and from the left side to the inner side;

wherein the vertical fold lines and the horizontal fold lines are arranged in a crisscross pattern of sections, wherein the vertical and horizontal fold lines are perpendicular to each other;

wherein the covering is transformable from a fully folded position to a fully unfolded position;

wherein the sections are arranged in a compressed, stacked configuration when the covering is disposed in the fully folded position; and wherein the covering has a toilet-seat shape in the fully unfolded position.

3. The toilet seat cover of claim 2 wherein the covering is formed of a fibrous material.

4. The toilet seat cover of claim 3 wherein the fibrous material comprises a soft cushion constructed of at least one ply paper.

5. The toilet seat cover of claim 4 wherein the fibrous material has thickness in a range of 0.10 millimeter to 25.4 millimeters.

6. A toilet seat cover comprising:

a flushable, foldable covering configured to fit onto, conform to, and cover a toilet seat having a forward open mouth, the covering comprising:

a top side configured to cover an entire top surface of the toilet seat;

a bottom side opposite the top side;

an outer edge continuously disposed between the top side and the bottom side, the outer edge having a pair of opposing front ends, a back end, a right side, a left side, a bottom end, and an inner side disposed between the front ends, the outer edge configured to cover an entire outer side of the toilet seat;

a channel centrally disposed in the bottom side;

an outer periphery continuously disposed along the channel, the outer periphery disposed adjacent the bottom end of the outer edge except for a portion proximal each of the front ends, wherein the portion of the outer periphery proximal each of the front ends is disposed a distance away form each of the front ends in a range of approximately one-eighth to one-quarter of a length from the front end to the back end;

an elastomeric edge continuously disposed along the outer periphery;

wherein the channel is configured to accommodate insertion of the toilet seat therethrough;

a plurality of straight foldable score lines disposed on the top side and the outer edge, the score lines comprising:

a plurality of vertical fold lines continuously disposed from each of the front ends to the back end; and a plurality of horizontal fold lines continuously disposed from the right side to the inner side and from the left side to the inner side;

wherein the vertical fold lines and the horizontal fold lines are arranged in a crisscross pattern of sections, wherein the vertical and horizontal fold lines are perpendicular to each other;

wherein the covering is transformable from a fully folded position to a fully unfolded position;

wherein the sections are arranged in a compressed, stacked configuration when the covering is disposed in the fully folded position; and wherein the covering has a toilet-seat shape in the fully unfolded position.

7. The toilet seat cover of claim 6 wherein the covering is formed of a fibrous material.

8. The toilet seat cover of claim 7 wherein the fibrous material comprises a soft cushion constructed of at least one ply paper.

9. The toilet seat cover of claim 8 wherein the fibrous material has thickness in a range of 0.10 millimeter to 25.4 millimeters.

* * * * *